United States Patent [19]

Roberts

[11] Patent Number: 4,862,535

[45] Date of Patent: Sep. 5, 1989

[54] ANTI-REFLUX PILLOW

[76] Inventor: Kaye H. Roberts, 102 Echo Glen Dr., Unit D3, Winston Salem, N.C.

[21] Appl. No.: 128,102

[22] Filed: Dec. 3, 1987

[51] Int. Cl.[4] ..... A61G 7/00; A47C 27/00

[52] U.S. Cl. ..... 5/431; 5/480; 5/450; 5/494; 604/386

[58] Field of Search ..... 5/431, 494, 449, 450, 5/480; 604/401, 399, 356, 386

[56] References Cited

U.S. PATENT DOCUMENTS

| | | | |
|---|---|---|---|
| 1,791,725 | 2/1931 | Joseph | 5/480 |
| 2,281,629 | 5/1942 | Snow | 5/431 |
| 2,404,505 | 7/1946 | Knecht | 5/432 |
| 2,495,482 | 1/1950 | Rogatz | 5/110 |
| 2,710,052 | 6/1955 | Witmer | 5/431 |
| 2,936,758 | 5/1960 | Csulits | 604/386 |
| 3,967,333 | 7/1976 | Boyd | 5/318 R |
| 4,171,549 | 10/1979 | Morrell et al. | 5/449 |
| 4,359,045 | 11/1982 | Cozzi | 5/431 |
| 4,383,713 | 5/1983 | Roston . | |
| 4,441,221 | 4/1984 | Enste et al. . | |
| 4,471,767 | 9/1984 | Guimond | 5/431 |
| 4,606,087 | 8/1986 | Alivizatos | 5/449 |
| 4,667,356 | 5/1987 | Holmquist | 5/449 |

FOREIGN PATENT DOCUMENTS

| | | | |
|---|---|---|---|
| 1590583 | 12/1976 | United Kingdom | 5/431 |

OTHER PUBLICATIONS

PEP, Inc. brochure, undated, "Reflux Reducer".

*Primary Examiner*—Gary L. Smith
*Assistant Examiner*—Eric K. Nicholson
*Attorney, Agent, or Firm*—Wigman & Cohen

[57] ABSTRACT

An anti-reflux support system for an infant is disclosed comprising a wedge-shaped support pillow having an inclined infant- supporting surface, an infant torso-encircling sling attachable to the infant-supporting surface of the support pillow, and fasteners carried by at least one of the pillow or the slings for securing the sling on the infant-supporting surface in any one of a plurality of positions. The support pillow includes internal spaced, vertically-oriented support baffles extending between the infant-supporting surface and the bottom surface, and a loose, particulate filler material. The filler material cooperates with the support baffles to impart the wedge-shape to the pillow and to permit the infant-supporting surface to be deformed concavely, and thus conform to the shape of the infant's torso, when the infant is placed on the infant-supporting surface. The torso-encircling sling includes a single elongated sheet of soft, preferably absorbent, material which is foldable into a diaper-like garment securable around the lower part of the infant's torso. Fasteners carried by the sling facilitate securing together facing sides of the folded sheet.

14 Claims, 1 Drawing Sheet

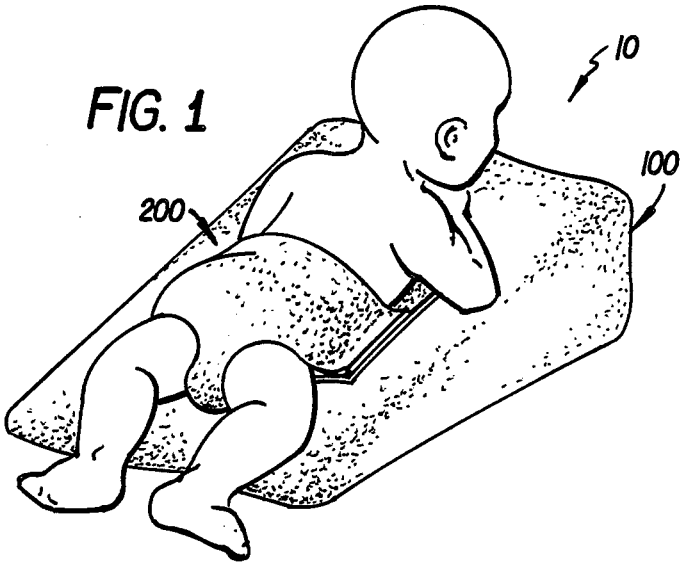
FIG. 1
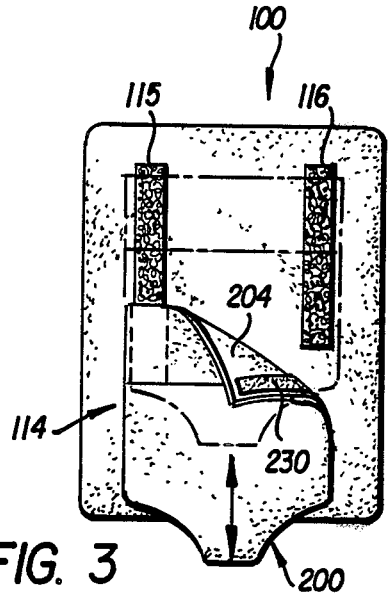
FIG. 3
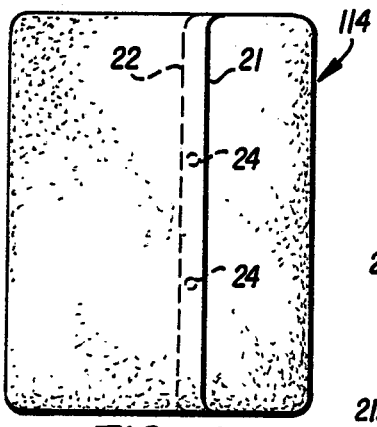
FIG. 4
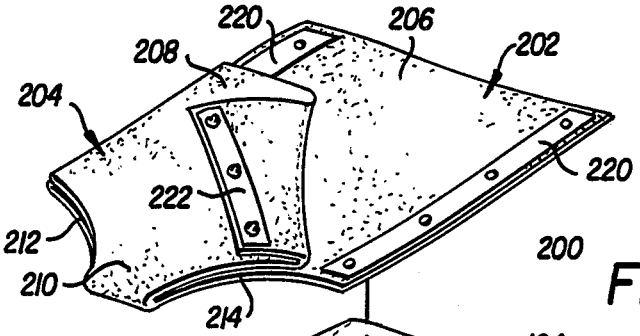
FIG. 2
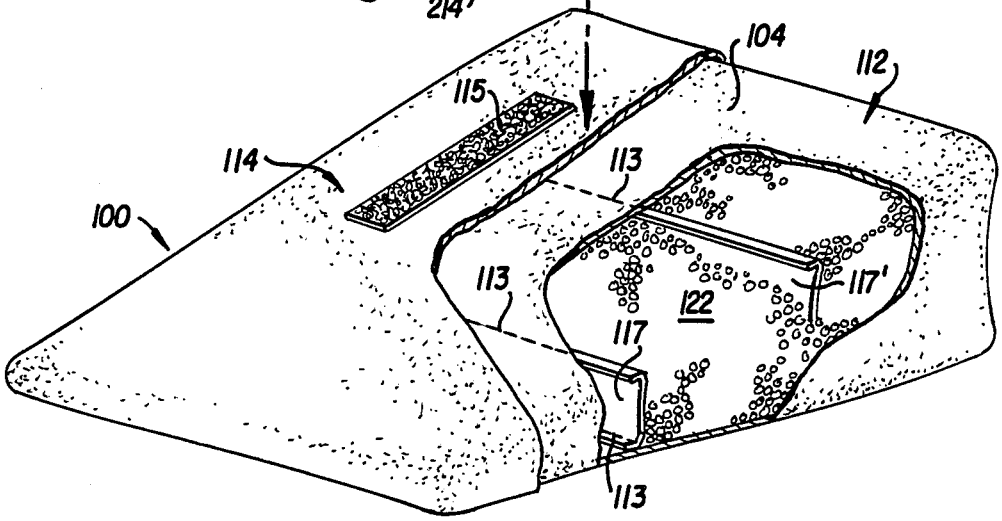

ANTI-REFLUX PILLOW

FIELD OF THE INVENTION present invention relates to therapeutic devices for positional treatment of patients for gastroesophageal reflux, and more particularly to an anti-reflux support system for supporting infant patients at a predetermined angle of inclination to minimize the occurrence of regurgitation.

BACKGROUND OF THE INVENTION

In intensive care nurseries, many patients are premature babies whose organs and bodily systems are typically insufficiently developed to carry out their functions without human, mechanical and/or chemical intervention.

An immature digestive system often results in a condition known as gastroesophageal reflux (GER), or regurgitation. Such a condition inhibits normal growth and nutrition, and can occur regardless of the manner of feeding. Thus, whether the patient is tube-fed or bottle-fed, formula from the stomach may reflux up through the esophagus, thereby presenting yet further problems, such as aspiration of the formula into the lungs, apnea (temporary cessation of breathing), respiratory infections, and lung damage.

As a prophylactic measure, physicians often order that infant patients be maintained in a prone position with the surface beneath their head raised as high as possible to enable the force of gravity to work against the reflux.

Raising the head-supporting surface of an infant patient's bed high enough is often difficult. Isolettes and open warmers are not designed to be raised more than a few inches at the head, while ordinary mattresses, if capable of being propped at the head region, require placement of foam wedges, diapers or blankets underneath in order to achieve an angle of inclination of from 30° to 45°. However, once the head region of the patient's bed is propped up, there is the problem of the infant sliding to the foot of the bed. Various impromptu, make-shift solutions have been employed to prevent the infant from sliding from a desired location on the supporting surface. For example, diaper slings have been secured to the bedding with safety pins, and surgical masks have been placed between the patient's legs with the patient tied up in the bed via the strings. However, even though the infants are tiny and weak, they nevertheless are capable of wriggling themselves free. Moreover, these rigged up contraptions can be very dangerous, and in the event of an emergency, it is difficult to quickly find and release all the safety pins or strings to get the patient out quickly. A situation such as this could be especially life-threatening if the infant is in need of cardiopulmonary resuscitation which requires a flat supine position.

U.S. Pat. No. 4,471,769 to Guimond discloses a therapeutic device for positional treatment of GER which consists of a flat padded bed portion which is supported in an inclined position by opposing vertical sides, and a rigid plastic seat secured, by fixed length rigid rods, to each of the vertical sides so that the seat is located atop a central region of the bed portion. The infant is placed in the seat by inserting the infant's legs through leg openings provided in the seat so that the main body portion of the seat receives and encircles the infant's torso. While this arrangement permits free and unrestricted movement of the infant's legs and upper body, in the event of an emergency immediate access to the infant is effectively impeded. In view of the fact that the seat is securely mounted to the device, great care must be taken to avoid injury to the infant's legs and feet when removing the infant from the seat. Further, in the arrangement of Guimond, if the infant soils the seat, cleaning either the infant or the seat requires removal of the infant from the seat and then removal of the seat and rods from the support. Moreover, even though padded, the plastic-covered bed portion of the Guimond device does not provide a soft surface against which the infant can snuggle, and which will provide the infant with a feeling of security and warmth.

Other similar supports for children are known but these devices function as restraints for handicapped children (e.g., U.S. Pat. No. 4,441,221 to Enste et al) or as orthopedic supports for infants (e.g., U.S. Pat. No. 4,383,713 to Roston).

SUMMARY OF THE INVENTION

It is therefore a primary object of the present invention to overcome all of the problems and disadvantages of the known prior devices by providing a safe, practical, aesthetically pleasing support system for securing an infant in an inclination suited for minimizing the occurrence of gastroesophageal reflux.

Another object of the present invention is to provide a wedge-shaped support pillow having a soft, infant-supporting surface which is conformable with the torso of an infant placed thereon and which is inclined to minimize the occurrence of GER.

Still another object of the present invention is to provide an anti-reflux support pillow for an infant which is constructed of a soft fabric having internally disposed, vertically oriented, stiffening baffles and containing redistributable filler material.

Yet another object of the invention is to provide an infant-supporting anti-reflux system including a wedge-shaped pillow support and a sling for releasably retaining an infant on an inclined surface of the pillow support so that, in a medical emergency, immediate release of the infant from the inclined surface is possible without first removing the infant from the sling.

These and other objects of the present invention are made possible by the provision of an anti-reflux support system for an infant which includes a wedge-shaped support pillow including an inclined infant-supporting surface, an infant torso-encircling sling adapted to be secured on the infant-supporting surface of the support pillow, and fastener means for securing the sling on the infant-supporting surface in any one of an infinite number of positions. The support pillow is provided internally with spaced, vertically-oriented support baffles extending between, and secured to, the infant-supporting surface and the bottom surface, and further is provided with a filler material, preferably a loose particulate material, which cooperates with the pillow cover and support baffles to impart the wedge-shape to the pillow and to permit the infant-supporting surface to deform concavely, and thus conform to the shape of the infant's torso, when the infant is placed on the infant-supporting surface. The torso-encircling sling includes a single elongated sheet of soft, preferably absorbent, material which is foldable into a diaper-like garment around the lower part of the infant's torso, and is provided with fasteners for securing together facing sides of the folded sheet. In the preferred embodiment, both the infant-supporting surface of the support pillow and an outer surface of the sling is provided with strips of interlocking releasable fastening means to enable the sling to be secured to the infant-supporting surface of the support pillow in any one of an infinite number of positions.

BRIEF DESCRIPTION OF THE DRAWINGS

These and other objects and advantages will become apparent upon a reading of the following detailed description of the invention, especially when considered in conjunction with the accompanying drawings in which:

FIG. 1 illustrates, in perspective view, the manner of use of the anti-reflux support system of the present invention;

FIG. 2 is an exploded, perspective view of the anti-reflux support pillow and the infant torso-encircling sling of the anti-reflux support system of the present invention, with a portion of the pillow being broken away to show the interior construction;

FIG. 3 is a top view of the anti-reflux support system of the present invention schematically illustrating the adjustability of attachment of the sling and the infant-supporting surface of the support pillow; and FIG. 4 is a bottom view of the novel anti-reflux support pillow.

DETAILED DESCRIPTION OF THE INVENTION

Referring now to the drawings, FIG. 1 illustrates the anti-reflux support system 10 of the present invention, and depicts one manner (to be described in greater detail below) in which the system is used to secure an infant in an inclined prone position to minimize the occurrence of GER or regurgitation during or after feeding of the infant. As shown, the support system 10 includes a wedge-shaped anti-reflux support pillow 100 and an infant torso-encircling sling 200.

The Support Pillow

Referring now to FIG. 2, the support pillow 100 is formed in the shape of a wedge having a substantially planar base or bottom surface 102 and a normally substantially planar, upper infant-supporting surface 104 disposed at an acute angle to the bottom surface 102. The pillow 100 comprises an inner shell 112 and an outer covering 114 removably fitted over the inner shell. The inner shell fabric is preferably water-resistant synthetic material, such as nylon, which is light-weight and capable of being wiped clean with a damp cloth or sponge. The back of the outer covering (see FIG. 4) is provided with an opening formed with overlapping flaps 21, 22 to permit the inner shell to be inserted into the outer covering. The flaps are secured together by fasteners 24, such as snap fasteners or the like, after the inner shell has been inserted. The outer covering is preferably made of a soft, non-toxic, color-fast fabric which is machine washable and capable of withstanding gas autoclaving.

A pair of attachment strips 115, 116 are secured to a central region of the outer covering 114 located atop the upper infant-supporting surface 104 of the inner shell (note FIGS. 2 and 3). The attachment strips are preferably made of a hook-and-loop fabric material, such as Velcro, or of an adhesive material, and are disposed in a parallel, spaced apart relationship. Located in the interior of the inner shell 112 are spaced, vertically oriented stiffening baffles 117, 117'. Two baffles are shown for purposes of illustration, but more or less than two may be used depending upon the degree of stiffness desired and the size of the pillow. The baffles are preferably made of the same fabric material as the inner shell but may be made of any other suitable stiffening material. The baffles 117, 117' function to divide the interior of the inner shell 112 into cells, and are preferably attached only at the upper and lower portions there of to the pillow surfaces 104, 102, respectively. In the embodiment of the invention illustrated in FIG. 2, the uppermost and lowermost regions of the baffles are formed into flanges and secured by stitching 113 to the respective interior faces of the inner shell.

A filler material 122 is also disposed within the inner shell and substantially fills the entire remaining internal volume. The filler material may comprise any soft, conformable material, and is preferably a particulate material, such as styrofoam balls. The filler material 122 is normally evenly distributed between the cells of the pillow shell 112 for providing the pillow upper face 104 with a generally planar surface and maintaining the wedge shape of the support pillow. Because the baffles are secured to the inner shell only at their uppermost and lowermost portions, the side edges of the baffles are free to move relative to the shell 112 and the filler material 122 can be redistributed among the cells of the support pillow. An "automatic" redistribution of the filler material between the cells will take place when an infant is placed on the upper surface 104 and the filler material immediately below the infant is displaced.

Manual redistribution of the filler material is also facilitated by the aforesaid manner of attachment of the baffles, and is desirable when using the support pillow for accommodating infants of different sizes and weights. For example, it is contemplated that the reflux pillow of the present invention will be used to support infants of different weights or lengths, and for each infant it will prove useful to first manually adjust the normal distribution of the filler material in the support pillow to provide a concavity or depression to receive and maintain the torso of the infant in a generally central region of the inclined upper support surface. The manual adjustment is accomplished by pressing the central region of the inclined upper surface (between attachment strips 115, 116) downwardly and then from side to side to form the concavity. The importance of the concavity is twofold: first, when an infant is placed in the concavity, he/she experiences a sensation of being held snuggly and securely, and second, after the infant has been placed on the upper surface, the lateral extremities of the concavity function as barriers to inhibit the infant from laterally rolling off the support pillow.

The Sling

The infant torso-encircling sling 200, as shown in FIG. 2, comprises a sheet of material having a front surface 202 and a rear surface 204, and includes a first portion 206 against which the infant's chest and abdomen is placed, a second portion 208 which in use is folded over the first portion to lie atop the infant's buttocks and lower back, and a third crotch portion 210 interconnecting the first and second portions and provided with inwardly extending arcuate cut-outs 212, 214 for receiving and encircling the infant's legs. The material of which the sling is made may comprise the same fabric used for the outer cover 114 of the pillow support, or the entire sling may be made of a disposable material. When using a non-disposable material for the sling, a lining of water-resistant fabric or of a disposable material may be included to facilitate quick and easy clean-up of the infant. The use of a disposable sling or a disposable lining material inside a non-disposable sling has the advantage of being easily discarded when it becomes soiled, thereby reducing laundering and/or sterilizing costs and time.

Secured to the front surface of the sling first portion 206 is a first set of fastener means 220. A second set of fastener means 222 (only one of which is shown in FIG. 2) is secured to the front surface of the sling second portion 208. Both sets of fastener means are attached at opposite lateral edges of their respective sling portions for releasably securing the sling second portion 208 to the sling first portion 206 when the former is folded and pulled up over the infant. The fastener means of each set are preferably snap-type fastener elements, but alternatively could be Velcro-type fasteners or any other suitable quick release-type fastener, such as adhesive materials. In either case, the fastener means permit attachment of the second portion to the first portion at different relative positions to accommodate infants of different sizes.

Referring now to FIGS. 2 and 3, the rear surface 204 of the first portion 206 of sling 200 is provided with parallel strips 230 of Velcro material (only one of the strips is shown in FIG. 3). The Velcro strips 230 are attached at opposite lateral edges of the first portion 206 and at a spacing which coincides with the spacing between the attachment strips 115, 116 secured to the outer covering of the pillow support 100. FIG. 3 illustrates sling 200 positioned for attachment to the upper infant-supporting surface 104 of the support pillow 100. The Velcro strips on the rear surface 204 of the sling first portion facilitate attachment of the sling to the support pillow at an infinite number of positions. For purposes of illustration, a first extreme position for attachment of the sling to the pillow is shown in solid lines in FIG. 3, while a second extreme position for attachment of the sling to the pillow is shown in broken lines in FIG. 3. It is to be understood that any other position between these two extreme positions can be chosen as well to ensure that infants of different body lengths are provided with adequate and appropriate support.

Use of The Support System of The Invention

In using the anti-reflux support system of the present invention, the sling 200 is first attached to the infant. This is accomplished by positioning the infant atop the front surface 202 of the sling so that the infant's chest and abdomen lie in contact against the to portion 206. The bottom portion 208 is then folded over the infant's buttocks and lower back and pulled up snug with the infant's crotch so that the infant's legs extend from the arcuate cut-outs 212, 214 in the crotch portion 210 of the sling. The folded-over and pulled-up bottom portion is then fastened to the top portion with fastener means 220, 222.

Once the sling is secured to the infant (or prior thereto), a depression or concavity is formed in the support pillow in the manner described above, and the infant is disposed at a desired location on the inclined support surface of the pillow so that the Velcro strips of the sling rear surface align with, and attach to, the attachment strips on the support pillow. After being placed on the support pillow in this manner, the infant is held securely in the desired inclination and further is prevented from rolling off either side of the pillow.

The anti-reflux support system of the present invention enjoys many advantages over the known similar devices. It is simple, safe, inexpensive to fabricate, and practical. It facilitates the feeding and care of infants while minimizing incidents of reflux and aspiration. The pillow of the system is soft and capable of conforming to the torso of the infant so that a sensation of security is afforded. Moreover, the softness and conforming capability of the pillow are believed to reduce the tendency of the infant to acquire a "fish head" (a condition in which the infant's head becomes flat and narrow on both sides resulting from lying on a hard mattress for an extended period of time).

Although only a preferred embodiment is specifically illustrated and described herein, it will be appreciated that many modifications and variations of the present invention are possible in light of the above teachings and within the purview of the appended claims without departing from the spirit and intended scope of the invention.

What I claim is:

1. An anti-reflux pillow for supporting the torso of an infant, comprising:

a wedge-shaped fabric shell of a first material, said shell including a base portion for engagement with a pillow-supporting surface and an infant-supporting portion disposed at an acute angle inclined relative to said base portion;

conformable filler means contained within said shell and comprising a material different from said first material, said filler means being substantially evenly distributed throughout said shell and being redistributable in said shell in response to placement of an infant on said infant-supporting portion, whereby a region of said infant-supporting portion of said pillow bearing the weight of the infant placed thereon will conform in a manner corresponding to the contour of the infant's torso to maintain said infant in said position, said shell comprising baffle means extending between said base portion and said infant-supporting portion for dividing said shell into cells containing said filler means, said filler means being redistributable between said cells by movement of said filler means around said baffle means;

sling means disposed on said infant-supporting portion for retaining the infant; and means located beneath said sling means for releasably attaching said sling means directly to said infant-supporting portion-in a plurality of different positions whereby the position of the infant on the infant-supporting portion cam be adjusted along the inclined surface thereof.

2. The anti-reflux pillow of claim 1, wherein said baffle means include a first portion attached to said infant-supporting portion of said shell and a second portion attached to said base portion of said shell, said baffle means further including unattached lateral portions, whereby redistribution of said filler means is accomplished by movement of said filler means around said baffle means from one cell to another cell.

3. The anti-reflux pillow of claim 1, wherein said filler means comprises a particulate material.

4. The anti-reflux pillow of claim 3, wherein said filler means comprises styrofoam balls.

5. The anti-reflux pillow of claim 1, wherein said sling means comprises an absorbent lining.

6. The anti-reflux pillow of claim 5, wherein one or both of said sling means and said absorbent-lining are disposable.

7. The anti-reflux pillow of claim 1, further comprising a wedge-shaped fabric cover within which said wedge-shaped shell is congruously, disposed, said cover having an opening for inserting said shell therewithin and releasable fasteners for closing said opening.

8. An anti-reflux support system for an infant, comprising:

a wedge-shaped fabric shell having a base for engagement with a horizontal surface and an inclined infant-supporting surface overlying said base, said fabric shell containing conformable filler material such that when the infant is placed upon said inclined surface, said inclined surface will deform toward said base to correspondingly accommodate to the contour of the infant's torso, said shell comprising a plurality of deformable stiffening members extending between and attached within said shell to said base and said inclined infant-supporting surface, respectively, said stiffening members dividing the internal volume of said shell into cells, said filler material being distributed in said cells of said shell and being redistributable from one cell to another around said stiffening members when said inclined surface is deformed in response tot he placement of the infant on the inclined surface;

means attachable to said infant-supporting surface and encircling the torso of an infant for retaining the infant on said infant-supporting surface, said infant-retaining means comprising a sling having first and second torso-encircling portions and means for releasably fastening the first and second torso-encircling portions together about the torso of the infant; and means located between said infant-retaining means and said infant-supporting means and carried on at least one of said infant-retaining means and said infant-supporting surface for releasably attaching said sling directly to the infant-supporting surface in any one of a plurality of different locations whereby the position of the infant along the length of said inclined surface is adjustable.

9. The anti-reflux support system of claim 8, and further comprising a wedge-shaped, washable, fabric cover for congruously encircling and covering said fabric shell.

10. The anti-reflux support system of claim 8 including arcuate cut-out portions in said first and second portions for receiving the legs of the infant.

11. The anti-reflux support system of claim 8 wherein said releasably fastening means comprises a plurality of snap fasteners on said first and second portions.

12. The anti-reflux support system of claim 8 wherein said infant-retaining means comprises a sling having an absorbent lining.

13. The anti-reflux support system of claim 12, wherein one or both of said sling and absorbent lining are disposable.

14. An anti-reflux support system for an infant comprising:

a wedge-shaped fabric shell having a base for engagement with a horizontal surface and an inclined infant-supporting surface overlying said base, said fabric shell containing conformable filler material such that when the infant is placed upon said inclined surface, said inclined surface will deform toward said base to correspondingly accommodate to the contour of the infant's torso, said shell comprising a plurality of deformable stiffening member extending between and attached within said shell to said base and said inclined infant-supporting surface, respectively, said stiffening members dividing the internal volume of said shell into cells, said filler material being distributed in said cells of said shell and being redistributable from one cell to another around said stiffening members when said inclined surface is deformed in response to the placement of the infant on the inclined surface;

means attachable to said infant-supporting surface and encircling the torso of an infant for retaining the infant on said infant-supporting surface, said infant-retaining means comprising a sling having first and second torso-encircling portions and means for releasably fastening the first and second torso-encircling portions together about the torso of the infant; and means carried on at least one of said infant-retaining means and said infant-supporting surface for releasably attaching said sling to the infant-supporting surface in any one of a plurality of different locations, said means for releasably securing the infant-retaining means to the infant-supporting surface comprising hook-and-loop fasteners secured to said infant supporting surface and to said sling whereby the position of the infant along the length of said inclined surface is adjustable.

* * * * *

UNITED STATES PATENT AND TRADEMARK OFFICE

CERTIFICATE OF CORRECTION

PATENT NO. : 4,862,535

DATED : September 5, 1989

INVENTOR(S) : Kaye H. ROBERTS

It is certified that error appears in the above-identified patent and that said Letters Patent is hereby corrected as shown below:

Column 1, line 5, before "present invention" insert --The--;

Column 5, line 54, delete "to";

Claim 1, column 6, line 53, "portion-in" should be --portion in--;

column 6, line 55, "cam" should be --can--.

Claim 4, column 6, lines 67 and 68 delete "filler means" and insert --particulate material--.

Claim 8, column 7, line 30, "tot he" should be --to the--.

UNITED STATES PATENT AND TRADEMARK OFFICE

CERTIFICATE OF CORRECTION

PATENT NO. : 4,862,535

DATED : September 5, 1989

INVENTOR(S) : Kaye H. Roberts

It is certified that error appears in the above-identified patent and that said Letters Patent is hereby corrected as shown below:

Claim 14, column 8, line 23, "member" should be --members--.

Signed and Sealed this

Fourth Day of September, 1990

*Attest:*

HARRY F. MANBECK, JR.

*Attesting Officer*

*Commissioner of Patents and Trademarks*